United States Patent [19]

Braid et al.

[11] Patent Number: 4,509,956

[45] Date of Patent: Apr. 9, 1985

[54] FUEL ADDITIVE AND METHOD OF USE

[75] Inventors: Milton Braid, Westmont; Phillip S. Landis, Woodbury, both of N.J.

[73] Assignee: Mobil Oil Corporation, New York, N.Y.

[21] Appl. No.: 194,738

[22] Filed: Oct. 7, 1980

Related U.S. Application Data

[63] Continuation of Ser. No. 922,906, Jul. 10, 1978, abandoned, which is a continuation-in-part of Ser. No. 899,682, Apr. 24, 1978, abandoned.

[51] Int. Cl.[3] ..... C10L 1/30

[52] U.S. Cl. ..... 44/68

[58] Field of Search ..... 44/68; 260/45.75 M, 260/439 R, 429 D

[56] References Cited

U.S. PATENT DOCUMENTS

| | | | |
|---|---|---|---|
| 2,380,299 | 7/1945 | Evans et al. | 260/429 D |
| 3,390,160 | 6/1968 | Heller et al. | 260/429 D |
| 4,119,548 | 10/1978 | Braid | 260/439 R |
| 4,151,100 | 4/1979 | Braid | 260/439 R |

*Primary Examiner*—Y. Harris-Smith

*Attorney, Agent, or Firm*—Alexander J. McKillop; Michael G. Gilman; Howard M. Flournoy

[57] ABSTRACT

Nitrogen oxygenates and particulate emissions in combustion engines are effectively suppressed when a minor effective amount of a transition metal energy transfer additive, e.g., iron, cobalt and copper complexed with a thiobisphenol are added to the engine's fuel.

9 Claims, No Drawings

FUEL ADDITIVE AND METHOD OF USE

REFERENCE TO RELATED APPLICATIONS

This is a continuation of copending application Ser. No. 922,906, filed July 10, 1978, now abandoned, which is a continuation-in-part of Ser. No. 899,682 filed Apr. 24, 1978 now abandoned entitled Additives For Improving the Research Octane Number of Liquid Hydrocarbon Fuels and now abandoned.

BACKGROUND OF THE INVENTION

1. Field of the Invention

This invention is directed to the substantial reduction of nitrogen compounds, such as NO and $NO_2$, and particulate emissions from combustion engines by the addition to the engine's fuel of an organosulfur-containing transition metal complex, e.g., nickel thiobis(4-t-octylphenol-phenolate). This invention is accordingly further directed to the novel use of these organosulfur-containing complexes as additives for reducing hydrocarbon base fuel emissions.

2. Description of the Prior Art

Energy-absorbing complexes and chelates of nickel are known for the stabilization of polymers against the effects of light.

Heskins and Guillet (1) first proposed the energy transfer mechanism of UV protection in 1968.

Commercially available UV stabilizers are listed by class and function, and identified as to structure, in the Kirk-Othmer Encyclopedia, 08 Chemical Technology, 2 Edition, Vol. 21, pages 115–122.

Uri(2) cites conventional antioxidant effects (hydroperoxide decomposition and free radical capture) of bis(stilbene-dithiolato)nickel.

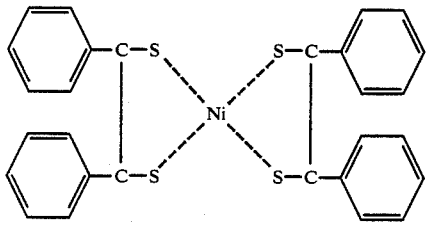

as well as its UV inhibiting properties. These functions, however, are discussed in terms of polymer and pure hydrocarbon substrates. Uri also summarizes the photo chemistry of excited species in polymer degradation.

Coping and Uri are authors of a British Patent Specification (3) which claims bis(stilbenedithiolato)nickel as antioxidant for organic materials including polymers and hydrocarbons.

It appears that no work in fuels, e.g., hydrocarbon fuels relative to energy transfer mechanisms and nickel organosulfur-containing complexes and chelates has been reported.

Concern for the environment is leading to more stringent requirements on engine emissions. Use of the energy-transfer additive concept, to minimize the reaction sequences which normally lead to $NO_x$ and/or particulate emissions, as an emission control route is therefore of major significance in fuel technology, particularly for diesel engines.

SUMMARY OF THE INVENTION

It has been found that transition metal thiobis(alkylphenols) and thiobis(alkylphenol-phenolates) when incorporated into hydrocarbon fuels substantially suppress, reduce and/or minimize the reaction sequences which normally lead to $NO_x$ and/or particulate emissions formed in the combustion chamber of internal combustion engines.

Accordingly this application is particularly directed to a method of substantially reducing the formation of undesirable noxious nitrogen compounds and particulate emissions in internal combustion engines comprising intimately admixing with the hydrocarbon base fuel used therein a minor effective amount of a transition thiobis(alkylphenolate) and/or a thiobis(alkylphenol-phenolate) having the following general structures

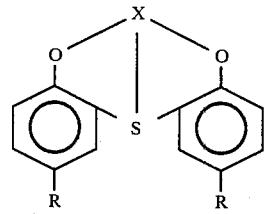

I and

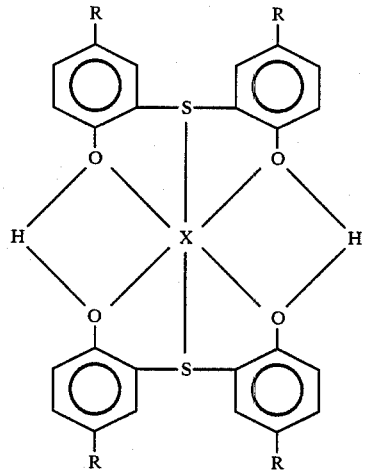

II where R is hydrogen or an alkyl group having from 1 to about 30 carbon atoms and wherein X is a transition metal selected from cobalt, copper, iron and nickel; and to compositions comprising liquid hydrocarbon fuels and said organosulfur-containing transition metal compounds such as the mixture comprising a liquid hydrocarbon fuel, e.g., a diesel fuel and a nickel thiobis(alkylphenolate).

Highly useful are transition metal thiobis complexes having a ratio of transition metal to thiobis phenol of 1 to 1.5, such as $X_2(TBP)_3$, e.g., $Co_2(TBP)_3$. Representative of such complexes is the following general structure:

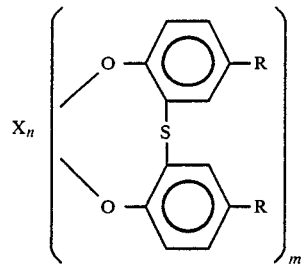

where R and X are as defined hereinabove, n=1 or 2 and m=1 to 3.

Especially preferred of the above-described complexes are those wherein the alkyl groups are 4-t-octyl or 1,1,3,3-tetramethyl-butyl.

DESCRIPTION OF SPECIFIC EMBODIMENTS

Generally speaking the complexes in accordance with this invention may be prepared in the manner disclosed by U.S. Pat. Nos. 2,971,940 and 2,971,941. For example, nickel thiobis(4-t-octylphenol-phenolate) structure II is a commercial product and is conveniently prepared in accordance with U.S. Pat. No. 2,971,940. Nickel thiobis(4-t-octylphenolate) structure I, may also be obtained commercially or may be prepared in a somewhat similar manner as described in U.S. Pat. No. 2,971,941. The complexes of cobalt, copper and iron may be conveniently prepared in similar manner. Additionally, the cobalt phenolates and phenol-phenolates may be prepared in accordance with co-pending U.S. applications, Ser. Nos. 847,461, filed Oct. 31, 1977 and 853,353, filed Nov. 21, 1977 now U.S. Pat. No. 4,151,100. The iron complexes may be prepared in accordance with co-pending Ser. No. 898,737 filed Dec. 13, 1977. However, the herein disclosed transition metal complexes may also be prepared in any manner fairly suggestive of or known in the prior art.

The organosulfur-containing complexes in accordance with the invention can be effectively employed in any amount which is sufficient for imparting to the organic medium, e.g., diesel fuel, the desired degree of protection against oxidative degradation. In many instances, the complex is effectively employed in an amount from about 0.01 to about 2.0%, by weight, and preferably in an amount from about 0.05% to about 0.50%, by weight, of the total weight of the composition. As hereinbefore indicated, the organic sulfur-containing complexes embodied herein may be incorporated into any liquid hydrocarbon combustion fuel normally subject to oxidative degradation.

For example, the additive complexes of the present invention impart antioxidant properties, as hereinbefore indicated, to liquid hydrocarbon combustion fuels, including the distillate fuels, i.e., gasolines and fuel oils. Accordingly, the fuel oils that may be improved in accordance with the present invention are hydrocarbon fractions having an initial boiling point of at least about 75°-100° F., and an end-boiling point no higher than about 750° F., and boiling substantially continuously throughout their distillation range. Gasolines, diesel fuels, gas turbine fuels and the like are included. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distallate stocks. Moreover, such fuel oils can be treated in accordance with well-known commercial methods, such as, acid or caustic treatment, hydrogenation, solvent refining, clay treatment etc.

The distillate fuel oils are characterized by their relatively low viscosities, pour points and the like. The principal property which characterizes the contemplated hydrocarbons, however, is the distillation range. As mentioned hereinbefore, this range will lie between about 75°-100° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specifications set forth in ASTM Specifications D396-48T. Specifications for diesel fuels are defined in ASTM Speficiation D975-48T. Typical jet fuels are defined in Military Specification MIL-F-5624B.

The gasolines that are improved by the additive compositions of this invention, are mixtures of hydrocarbons having an initial boiling point falling between about 75° F. and about 135° F. and an end-boiling point falling between about 250° F. and about 450° F. As is well known in the art, motor gasoline can be straight run gasoline or, as is more usual, it can be a blend of two or more cuts of materials including straight run stock, catalytic or thermal reformate, cracked stock, alkylated natural gasoline, and aromatic hydrocarbons. This invention is particularly adaptable to diesel fuels. However, additive compositions comprising the complexes in accordance with this invention and liquid hydrocarbon fuels such as gasolines or diesel fuels are preferred embodiments.

The following data contained in Tables 1 and 2 are merely exemplary and are not meant to be limiting.

EXAMPLE 1

The base fuel[1] used for vehicle emission testing was a liquid hydrocarbon diesel engine fuel (Example 1) having the following general properties:

| | |
|---|---|
| Gravity, °API | 35.8 |
| Sp. Gravity | 0.8458 |
| Distillation, °F. | |
| % Recovered, IBP | 368 |
| 10 | 431 |
| 50 | 500 |
| 90 | 640 |
| 95 | 650 |
| EP | 664 |
| Cetane Number | 48 |
| Viscosity, Centistokes at 100° F. | 3.04 |

[1]Tables 1 and 2

EXAMPLE 2

Example 2 is a readily available commercial smoke suppressant additive containing overbased barium sulfonate used for comparison purposes.

EXAMPLE 3

Nickel thiobis(4-t-octylphenol-phenolate) was obtained commercially. Its method of preparation is as described in the aforementioned U.S. Pat. No. 2,971,941.

EXAMPLE 4

The base fuel (see Table 3) used for the photochemical reactions test was a blend of one part of the diesel fuel described as Example 1, and two parts of a lower boiling hydrocarbon fuel, i.e., BP of about 275° F.

EXAMPLE 5

$Fe(TBP)_2$; iron 2,2'-thiobis-(4-t-octylphenol-phenolate) was prepared in the following manner: To a solution of 2,2'-thiobis-(4-t-octylphenol) (88.4 g.) in xylene (300 ml) heated almost to reflux temperature (about 130° C.) there was added while stirring under a nitrogen atmosphere anhydrous iron II acetate (17.39 g.). The temperature was raised and an azeotropic mixture of xylene and acetic acid was removed by distillation while fresh xylene was concurrently added to maintain approximately constant volume of the reaction mixture. This process was continued for several hours until no further trace of acetic acid could be detected. The reaction mixture was freed of solvent by rotary evaporation and the residue was extracted with pentane. The extract was then filtered to remove any unreacted thiobis phenol and inorganics. Removal of the solvent pentane from the filtrate left the iron 2,2'-thiobis-(4-t-ocytlphenol-phenolate) as a dark purple friable solid, m.p. 90°-93° C.

Anal. Calc'd for $C_{56}H_{82}O_4S_2Fe$: C, 71.61; H, 8.80; S, 6.83; Fe, 5.95 Found: C, 72.02; H, 8.90; S, 6.46; Fe, 5.86.

EXAMPLE 6

Copper thiobis(4-t-octylphenol-phenolate) was prepared as follows:

A mixture of 2,2'-thiobis-(4-t-octylphenol) (100 g.) and copper II acetate monohydrate (22.8 g.) in xylene (300 ml) was refluxed while stirring for about 1 hr. while all of the water and some acetic acid was removed as an azeotropic distillate. Heating and stirring were continued for an additional 4.5 hr. during which xylene and acetic acid were azeotropically distilled from the reaction mixture and fresh xylene was added concurrently to replace the distillate. At the end of this period acetic acid could no longer be detected in the distillate. Xylene solvent was removed from the reaction mixture by rotary evaporation. The dark brown semi-solid residue was extracted with cyclohexane. The insoluble solids (41.9 g) were recrystallized from isooctane to afford the brown solid copper complex, m.p. 150°-155° C., for which the elemental analysis corresponded to a composition containing copper and 2,2'-thiobis-(4-t-octylphenol) in the ratio of 1:2.

Anal. Calc'd for $C_{56}H_{82}O_4S_2Cu$: C, 71.03; H, 8.73; S, 6.77; Cu, 6.71; Found: C, 70.13; H, 8.85; S, 6.31; Cu, 6.00.

Evaporation of solvent from the cyclohexane extract left a brown solid residue which was treated with petroleum ether b.p. 30°-60° C. to separate a small amount of unreacted thiobis(alkylphenol). The mixture was filtered and the filtrate was stripped of the solvent to leave as a brown solid residue (54.6 g.), an isomeric copper complex of 2,2'-thiobis-(4-t-octylphenol), m.p. 108°-112° C., with elemental analysis again corresponding to a ratio of 1:2.

Anal. Calc'd for $C_{56}H_{82}O_4S_2Cu$: C, 71.03; H, 8.73; S, 6.77; Cu, 6.71; Found: C, 70.84; H, 8.52; S, 6.54; Cu, 6.31.

As part of a diesel vehicle emission study the overbased barium sulfonate and Example 3 nickel thiobis (4-t-octylphenol-phenolate) were directly evaluated as fuel additives in an Opel 2100D to determine their effect on gaseous ($NO_x$) and particulate emissions. The commercial smoke suppressant, was used at a concentration of 800 ppm (by weight) barium as recommended by the manufacture; the nickel complex was evaluated at a concentration of 340 ppm (by weight) of nickel. This concentration was used to provide equivalent molar concentrations of metal for both additive blends. The results are shown in Tables 1 and 2.

In all cases, the use of the nickel complex in accordance with this invention reduced the $NO_x$ emission by 20-40% compared with base fuel without the additive; $NO_x$ emissions were also reduced using the smoke depressant but the % reductions were not as great. In addition, in all but the maximum speed/maximum load condition, use of the nickel complex additive reduced the particulate emissions. Again, decreases for the smoke depressant were not as large as for the nickel thiobis(alkylphenol-phenolates) in accordance herewith.

The test procedure to study particulate and $NO_x$ emissions from diesel engine cars was as described below:

The total engine exhaust was diluted with filtered air drawn through an 18-inch by 14-feet dilution tunnel (similar in design to that used by EPA at their Ann Arbor, Michigan facility). The test car with 50 gals. of test fuel (Example 1) in its tank was placed on a chassis rolls and warmed up by operating for approximately one hour at 50 mph road load. The exhaust emission and particulate sampling systems and the Chemiluminescent Analyzer for $NO_x$ are then checked concurrently for proper operation.

The car was then driven for 30 minutes at each of the conditions shown in Tables 1 and 2. Data was taken every 10 minutes. Samples of the particulate emissions are sampled from the dilution tunnel using 0.8 um Millipore filters. The filters are dried at 150° F. and stored in a dessicator until used. After sampling, they were stored in a dessicator, again heated overnight to 150° F. and then weighed.

TABLE 1

| Conditions | | $NO_x$ Emissions[1], g/Kg of Fuel | | |
|---|---|---|---|---|
| mph | Load, lbs. (Tractive Effort) | Example 1 (Base Fuel) | Base + Example 2[2] | Base + Example 3[3] |
| 50 | 120 | 20.3 | 19.6 | 16.4 |
| 50 | 50 | 22.7 | 24.0 | 17.9 |
| 25 | 120 | 23.4 | 22.4 | 17.1 |
| 25 | 50 | 31.9 | 24.9 | 18.8 |
| | Idle - 800 rpm | 29.6 | 24.0 | 18.2 |
| | Idle - 650 rpm | 30.7 | 33.8 | 20.9 |

[1]Opel 2100 D Sedan
[2]Concentration provides 800 ppm (wt.) barium
[3]Concentration provides 340 ppm (wt.) nickel: $Ni(TBP)_2$

TABLE 2

| Conditions | | Particulate Emissions[1], g/Kg of Fuel | | |
|---|---|---|---|---|
| mph | Load, lbs. (Tractive Effort) | Example 1 (Base Fuel) | Base + Example 2[2] | Base + Example 3[3] |
| 50 | 120 | 3.57 | 3.27 | 3.74 |
| 50 | 50 | 2.98 | 2.66 | 1.85 |
| 25 | 120 | 1.52 | 1.47 | 1.31 |
| 25 | 50 | 1.21 | 1.44 | 1.08 |
| | Idle - 800 rpm | 3.24 | 2.27 | 2.20 |
| | Idle - 650 rpm | 3.04 | 2.86 | 2.86 |

[1]Open 2100 D Sedan, particulates sampled from a dilution tunnel using 0.8 μm Millipore filters.
[2]Concentration provides 800 ppm (wt.) barium
[3]Concentration provides 340 ppm (wt.) nickel As a further illustration of the utility of this invention, selected samples of fuel blended with additives in accordance herewith were subjected to a standard Window Sill (or Photochemical) Test. The test determines via sunlight exposure the ability of the additives to minimize photochemical reactions and hence particulate emissions. The samples which were a blend of one part of regular diesel fuel and two parts of a lower boiling hydrocarbon fuel as described above were placed in 4-oz. glass bottles and exposed over a 5-day period to bright sunlight. The results are tabulated in Table 3. The lower the rating the lower the amount of photochemical activity. The samples were rated for haze and sludge formation and as in the prior evaluation a commercial smoke suppressant (800 ppm Ba) was evaluated for comparison.

TABLE 3

| Window Sill Test - 5 Days Photochemical Reactions via Sunlight Exposure | | | |
|---|---|---|---|
| | Additive | Haze | Sludge |
| Base Fuel (Example 4) | None | 4 | 4 |
| Base Fuel + (Example 2) | 0.35% | 3 | 3 |
| Base Fuel + (Example 3) | 0.5% | 2 | 2 |
| Base Fuel + (Example 5) $Fe(TBP)_2$ | 0.5% | 1 | 1 |
| Base Fuel + (Example 6) $Cu(TBP)_2$ | 0.5% | 1 | 2 |

Base Fuel/part regular diesel blended with two parts of a lower boiling hydrocarbon fuel.

The data tabulated in Tables 2 and 3 clearly demonstrate the utility of this invention in liquid hydrocarbon fuels. As noted from the tables, the characteristics of the present invention, i.e., novel complexes of transition metals with organosulfur-containing ligands have proven to be markedly superior in direct comparison with a prior art smoke suppressant.

While this invention has been described with reference to preferred compositions and components therefor, it will be understood by those skilled in the art that departure from the preferred embodiments can be effectively made and are within the scope of the specification.

What is claimed is:

1. The method of substantially reducing the formation of undesirable noxious nitrogen oxide compounds and particulate emissions in internal combustion engines comprising intimately admixing with the hydrocarbon base fuel used therein a minor effective amount of a thiobis (alkylphenolate) and/or a thiobis (alkylphenolphenolate) having the following general structures:

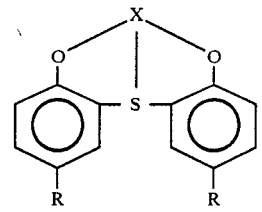

and

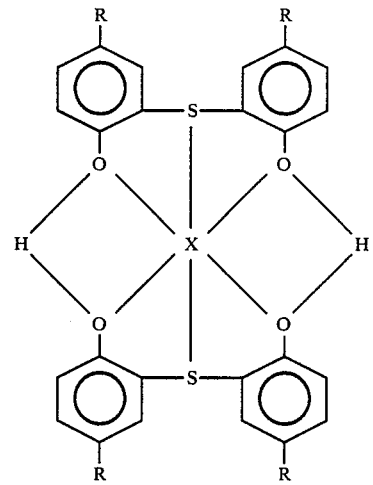

where R is hydrogen or an alkyl group having from 1 to about 30 carbon atoms and X is copper and wherein the hydrocarbon base fuel is selected from hydrocarbon fractions having an initial boiling point of at least about 75° to 100° F. and an end boiling point no higher than about 750° F. and boiling substantially continuously throughout their distillation range and wherein said hydrocarbon base fuel is a gasoline; a diesel fuel or a gas turbine fuel.

2. The method of claim 1 in which the hydrocarbon base fuel is a distillate diesel fuel.

3. The method of claim 1 in which the organosulfur-containing complex is employed in an amount from about 0.01 weight percent to about 2.0 weight percent.

4. The method of claim 1 in which the complex is a copper thiobis(alkylphenolate).

5. The method of claim 1 in which the alkyl group of the copper complex contains from 4 to about 16 carbon atoms.

6. The method of claim 1 in which the alkyl group of the copper complex is 4-t-octyl.

7. The method of claim 1 in which the copper complex is copper thiobis(4-t-octylphenolate).

8. The method of claim 1 in which the hydrocarbon base fuel is selected from hydrocarbon fractions having an initial boiling point of about 75° F. and an end point of about 450° F.

9. The method of claim 8 in which the hydrocarbon fuel is a gasoline.

* * * * *

UNITED STATES PATENT AND TRADEMARK OFFICE

CERTIFICATE OF CORRECTION

PATENT NO. : 4,509,956

DATED : April 9, 1985

INVENTOR(S) : Milton BRAID et al

It is certified that error appears in the above-identified patent and that said Letters Patent is hereby corrected as shown below:

Column 1, Line 19, "nickel" should be --iron, cobalt and copper--.

Signed and Sealed this

*Seventeenth* Day of *September 1985*

[SEAL]

*Attest:*

DONALD J. QUIGG

*Attesting Officer*

*Commissioner of Patents and Trademarks—Designate*